US007101144B2

(12) United States Patent
Haje et al.

(10) Patent No.: US 7,101,144 B2
(45) Date of Patent: Sep. 5, 2006

(54) STEAM TURBINE ROTOR, STEAM TURBINE AND METHOD FOR ACTIVELY COOLING A STEAM TURBINE ROTOR AND USE OF ACTIVE COOLING

(75) Inventors: Detlef Haje, Bottrop (DE); Dietmar Röttger, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 101 days.

(21) Appl. No.: 10/773,038

(22) Filed: Feb. 5, 2004

(65) Prior Publication Data

US 2004/0247433 A1 Dec. 9, 2004

(30) Foreign Application Priority Data

Feb. 5, 2003 (EP) ..... 03002472

(51) Int. Cl.
*F01D 5/14* (2006.01)

(52) U.S. Cl. ..... 415/115; 415/116; 416/198 A; 416/97 R

(58) Field of Classification Search ..... 415/115, 415/116–117, 100, 102–103; 416/198 A
See application file for complete search history.

(56) References Cited

U.S. PATENT DOCUMENTS

| | | | | |
|---|---|---|---|---|
| 2,451,261 A | | 10/1948 | Warren et al. | |
| 2,815,645 A | | 12/1957 | Downs | |
| 3,291,447 A | | 12/1966 | Brandon | |
| 4,551,063 A | | 11/1985 | Raschke et al. | |
| 5,232,339 A | * | 8/1993 | Plemmons et al. | 415/178 |
| 5,380,154 A | * | 1/1995 | Norton et al. | 415/209.2 |
| 6,082,962 A | * | 7/2000 | Drosdziok et al. | 415/115 |
| 6,102,654 A | * | 8/2000 | Oeynhausen et al. | 415/115 |
| 6,227,799 B1 | * | 5/2001 | Kuhn et al. | 415/115 |

FOREIGN PATENT DOCUMENTS

| | | |
|---|---|---|
| DE | 898 100 | 11/1953 |
| EP | 1 154 123 A1 | 11/2001 |
| EP | 1 209 321 A2 | 5/2002 |
| JP | 58135304 | 8/1983 |
| JP | 58143102 | 8/1983 |
| JP | 58155203 | 9/1983 |
| JP | 60159304 | 8/1985 |
| JP | 61001809 | 1/1986 |
| WO | WO 97/49901 | 12/1997 |

OTHER PUBLICATIONS

Von H.G. Neft und G. Franconville, Neue Dampfturbinenkonzepte fur hohere Eintrittsparameter und langere Endschaufeln, VGB Kraftwerkstechnik 73 (1993), Heft 5, pp. 409-415.

* cited by examiner

*Primary Examiner*—Edward K. Look
*Assistant Examiner*—Devin Hanan

(57) ABSTRACT

The proposed steam turbine rotor extends along an axial extent and includes: an outer side which adjoins an outer space which is intended to receive a main flow of a fluid working medium, a first location along the outer side, at which a first blade is held, a second location along the outer side, at which a second blade is held, the second location being arranged behind the first location along the axial extent. To ensure sufficient cooling, there is at least one integrated passage, which extends continuously at least between a first region arranged in front of the first location and a second region arranged behind the second location The invention proposes a method and a use in which a fluid cooling medium is guided in a corresponding way.

22 Claims, 6 Drawing Sheets

STEAM TURBINE ROTOR, STEAM TURBINE AND METHOD FOR ACTIVELY COOLING A STEAM TURBINE ROTOR AND USE OF ACTIVE COOLING

CROSS REFERENCE TO RELATED APPLICATIONS

This application claims priority to the European application No. 03002472.3 EP, filed Feb. 5, 2003 under the European Patent Convention and which is incorporated by reference herein in its entirety.

FIELD OF INVENTION

The invention relates to a steam turbine rotor which extends along an axial extent and includes: an outer side, which adjoins an outer space which is intended to receive a main flow of a fluid working medium and a first location along the outer side, at which a first row of blades is held. The invention also relates to a steam turbine. Furthermore, the invention relates to a method for actively cooling a steam turbine rotor of said type.

BACKGROUND OF INVENTION

When hot steam is applied to a steam turbine as working medium, targeted cooling of highly loaded components is desirable in order to increase the steam temperatures which can be reached. Where possible, this targeted cooling encompasses shielding and dissipation of heat through corresponding levels of cooling. In the context of the present application, a steam turbine is to be understood as meaning any turbine or part-turbine through which a working medium in the form of steam flows. By contrast, gas turbines have gas and/or air flowing through them as working medium, but this medium is subject to completely different temperature and pressure conditions than the steam in a steam turbine. Unlike in gas turbines, in steam turbines the working medium flowing to a part-turbine, for example, reaches its highest pressure at the same time as it is at its highest temperature. Therefore, an open cooling system cannot be realized without a cooling medium being supplied from the outside of the part-turbine. It has consequently proven impossible for cooling measures which are known from gas turbines to be transferred to steam turbines in the form which is known for gas turbines and is only suitable for gas turbines.

A casing of a steam turbine is to be understood as meaning in particular the stationary casing component of a steam turbine or part-turbine, which along the axial extent of the steam turbine has an inner space which is intended for the working medium steam to flow through. Depending on the particular type of steam turbine, this may be an inner casing and/or a guide vane carrier. A steam turbine casing is also to be understood as meaning a turbine casing which does not have an inner casing or a guide vane carrier.

A rotor fitted with blades is arranged rotatably along the axial extent in the inner space, so that when heated and pressurized steam flows through the inner space the steam makes the rotor rotate by means of the blades. The blades of the rotor are also known as rotor blades. Furthermore, a steam turbine has stationary guide vanes which penetrate into the spaces between the rotor blades and are held by the inner casing/guide vane carrier. A rotor blade is usually held along an outer side of a steam turbine rotor. It usually forms part of a ring of rotor blades which comprises a number of rotor blades which are arranged along an outer circumference on the outer side of the steam turbine rotor. The main blade part of each rotor blade faces radially outward. A ring of rotor blades is also referred to as a row of rotor blades. A number of rows of rotor blades are usually positioned behind one another. Accordingly, a further, second ring of blades is held along the outer side of the steam turbine rotor at a second location behind the first location along the axial extent.

With the cooling methods which have been disclosed hitherto, in particular for a steam turbine rotor, a distinction has to be drawn between active cooling and passive cooling. In the case of active cooling, cooling is brought about by a cooling medium which is fed to the steam turbine rotor separately, i.e. in addition to the working medium. By contrast, passive cooling is brought about only by suitably guiding or using the working medium in the main flow. Standard cooling of a steam turbine rotor is restricted to passive cooling.

By contrast, it is known from U.S. Pat. No. 6,102,654 and WO 97/49901 for cool steam which has already expanded to flow through a rotor of a steam turbine. In this case, cooling medium is passed through a substantially central cavity along an inner rotor wall and is then fed from there to the outside, in particular to regions of the casing which are to be cooled, via separate radial branch channels. Since the central cavity and the branch channels are arranged at the location where the component is subject to the highest levels of loading, this is highly disadvantageous for the rotor strength. It has the further drawback that a temperature difference across the rotor wall has to remain limited, since otherwise the rotor would be excessively thermally deformed in the event of an excessive temperature difference. For these reasons, a concept of this nature has not yet achieved widespread use. Although heat is dissipated as it flows through the rotor, the dissipation of heat takes place relatively far away from the location where the heat is supplied. Hitherto, it has not been possible to achieve sufficient dissipation of heat in the immediate vicinity of where the heat is supplied.

Further, passive cooling can be achieved by suitably guiding and using the expansion of the steam of the working medium. In this case, the steam which flows to a steam turbine is first of all expanded by exclusively stationary parts, e.g. a ring of guide vanes or radially acting guide vanes, before it is applied to rotating components. In the process, the steam is cooled by approximately 10 K. However, this method can only achieve a very limited cooling action on the rotor.

U.S. Pat. No. 6,102,654 realizes active cooling of a steam turbine rotor to only a very restricted extent, and moreover the cooling is limited to the inflow region of the hot working medium. As shown in FIG. 1 of this application, according to U.S. Pat. No. 6,102,654 cooling medium is passed through the casing onto a protective shield and onto a first ring of guide vanes, in order to reduce the thermal load on the rotor and the first ring of guide vanes. Some of the cooling medium is admixed with the working medium. Aside from the fact that the cooling is restricted to the inflow region, cooling is only supposed to be brought about by flow onto the components which are to be cooled. The cooling effect on the rotor which can be achieved as a result is limited, since it is restricted to the inflow region of the main flow.

It is known from WO 97/49901 for a single ring of guide vanes to be cooled selectively through a separate radial channel in the rotor, fed from a central cavity. For this purpose, cooling medium is admixed with the working medium via the channel, and cooling medium flows selectively onto the ring of guide vanes which is to be cooled. The cooling effect on the rotor is still in need of improvement. Furthermore, the bore disadvantageously increases the rotor stresses significantly compared to the configuration without a bore.

EP 1154123 has described a possible way of removing and guiding a cooling medium from other regions of a steam system and the supply of the cooling medium in the inflow region of the working medium.

To achieve higher efficiency levels in the generation of power using fossil fuels, there is a need to employ higher steam parameters, i.e. higher pressures and temperatures, than has hitherto been customary. In this context, if steam is used as the working medium, pressures of over 250 bar and temperatures of over 540° C. are intended. Steam parameters of this nature are described in detail in the article "Neue Dampfturbinen-konzepte für höhere Eintrittsparameter und längere Endschaufeln" [Novel steam turbine concepts for higher entry parameters and longer end blades] by H. G. Neft and G. Franconville in the Journal VGB Kraftwerkstechnik, No. 73 (1993), Volume 5. The content of disclosure of this article is hereby incorporated by reference in the description of the present application. In particular, examples of higher steam parameters are cited in FIG. 13 of the article. In the abovementioned article, a cooling steam supply and passage of the cooling steam through the first guide vane stage and if appropriate also through the second guide vane stage is proposed in order to improve the cooling of a steam turbine rotor. This provides active cooling only for the steam turbine casing. Moreover, the cooling is restricted to the main flow region of the working medium and is still in need of improvement.

Therefore, all the methods which have been disclosed hitherto for cooling a steam turbine rotor, if they are active cooling methods at all, at best provide for a directed flow onto a separate turbine part which is to be cooled and are restricted to the inflow region of the working medium. When higher steam parameters are applied to standard steam turbines, an increased thermal load may result over the entire turbine, and this load could only be alleviated to an insufficient degree by standard cooling of the rotor as described above. Steam turbines which use higher steam parameters in order to achieve higher efficiencies, for example, require improved cooling, in particular of the rotor, in order to sufficiently break down the higher thermal loads on the steam turbine. This gives rise to the problem that when turbine materials which have hitherto been customary are employed, the increasing load on the rotor resulting from increased steam parameters may lead to a disadvantageous thermal load on the rotor and to an unacceptable increase in the temperature of the rotor.

SUMMARY OF INVENTION

Therefore, it is an object of the present invention to provide a device and a method and a use which ensure sufficient cooling of a steam turbine rotor, in particular when a steam turbine is operated with increased steam parameters and standard turbine materials.

This object is achieved by the invention by means of a steam turbine rotor as described in the introduction in which at least one integrated passage is provided, which extends continuously at least between a first region arranged in front of the first location and a second region arranged behind the first location.

The invention is based on the consideration that to provide sufficient cooling for a steam turbine rotor, active cooling which goes beyond the inflow region of the working medium and beyond the simple separate cooling of the first blade stage should be provided within a steam turbine rotor. The discovery of the present invention resides in the fact that this can be achieved with a passage which is integrated continuously in the rotor going at least beyond one blade stage. This creates the possibility of active cooling of a considerable part or all of the rotor which receives the rotor blades. The part of the rotor in any event goes beyond the inflow region and at least goes beyond one blade stage. The part advantageously extends over at least two blade stages, expediently over several stages of the rotor blading. This creates the possibility of supplying a cooling fluid continuously by means of a combined passage system which is integrated in the rotor.

This has the significant advantage not only that the cooling of a steam turbine rotor takes place continuously over at least one, advantageously a plurality of, blade stages, i.e. at least between a first region arranged in front of the first location and a second region arranged behind the first location, but also that the dissipation of heat takes place in the immediate vicinity of where the heat is supplied, specifically in the vicinity of its surface. In this way, the cooling used in standard steam turbines is improved, meaning that they could be produced at lower materials costs. Furthermore the proposed cooling concept makes it possible to design new steam turbine concepts for higher entry parameters, in particular even for the highest steam parameters, as exist, for example, at temperatures of over 500° C. Examples of this are to be found in the above-referenced article "Neue Dampfturbinenkonzepte für höhere Eintritts-parameter und längere Endschaufeln" by H. G. Neft and G. Franconville. Examples for the steam parameters of the steam as a working medium are, for example, 250 bar and 545° C. or 300 bar and 600° C.

Advantageous refinements of the invention are to be found in the subclaims relating to the steam turbine rotor and provide details of advantageous ways of developing the proposed rotor in detail with a view to achieving the abovementioned and other advantages.

A particularly preferred refinement provides a second location along the outer side, at which a second row of blades is held, the second location being arranged behind the first location along the axial extent, and the passage extending continuously at least between a first region arranged in front of the first location and a second region arranged behind the second location. It would also be possible for a number of further locations at each of which a row of blades is held, to be provided between the first location and the second location. In particular, the at least one passage is advantageously part of a combined passage system which extends along the axial extent of the steam turbine rotor. This provides the option of guiding cooling steam parallel to the main flow. The cooling of a plurality of blade stages is as far as possible allowed to take place along the entire rotor. Depending on the particular demands and requirements, it would be possible to design a flexible passage system. The at least one passage could expediently extend continuously between a first region arranged in front of the first ring of blades and a second region arranged behind the last ring of blades. However, a passage system could also be composed of sub-systems. In this case, it would in addition, or as an alternative, be possible to provide a first number of passages which each run continuously over one or more blade stages along the axial extent. They could in this case be connected to a passage system via further, second passages, oriented radially or in any other desired way. The at least one passage or the first number of passages are in this case advantageously arranged close to the surface. The further, second passages could also run inside the rotor or lead out of the rotor surface, as desired.

It is expedient to provide an open cooling system which provides the option of matching the parameters of the cooling medium to the parameters of the working medium. This is explained in more detail below with reference to the proposed method.

Unlike the working medium in gas turbines, the incoming working medium in steam turbines is at its highest pressure at the same time as it is at its highest temperature. Therefore, in a steam turbine rotor, the at least one passage is expediently part of a combined passage system which has an external feed which is provided for the incoming flow of cooling medium. This provides the option of supplying the cooling medium to the passage at a pressure which is at least slightly higher than that of the working medium. This can advantageously be achieved by the cooling medium being removed from the water-steam circuit at a location of relatively high pressure and sufficiently low temperature.

The text which follows describes further advantageous configurations of a passage system, of which the at least one passage in accordance with the proposed concept forms part. A passage system of this nature is advantageously arranged close to the surface on the outer side of the steam turbine rotor. In this context, the term close to the surface means in particular that the passage system, especially the at least one passage, is arranged in a region of the radial extent of the steam turbine rotor which is delimited by the outer side of the rotor on one side and the inner radial extent of a rotor blade groove on the other side. The at least one passage and/or any further passage of the passage system may in this case, depending on the particular requirements, advantageously be designed as a channel or as any desired type of cavity inside the rotor, preferably in the region close to the surface of the latter. This allows the dissipation of heat at the location where heat is introduced to be improved further. The proposed cooling concept inside the abovementioned steam turbine rotor therefore acts more effectively than cooling which acts on the inner side of the rotor wall, adjacent to the rotor axis, in the vicinity of a central cavity. Furthermore, advantages supervene in terms of the deformation characteristics of a steam turbine rotor. The cooling using the proposed concept also reinforces the benefit of thermally insulating layers on rotor and blades. Layers of this nature have a relatively low heat conduction coefficient and can build up a high temperature difference, provided that a sufficient heat sink is provided. This means that rotor, blade roots and in some cases also main blade parts can be held at a significantly lower temperature than without an insulating layer. As an alternative to an insulating layer, or in combination with such a layer, it may be useful, when employing the proposed cooling concept, to use blade materials of less good conductivity. A preferred example of such materials is formed by austenitic materials.

A combined passage system expediently includes a channel which at least partially encircles a circumferential extent of the rotor. Together with the at least one axially running passage, this allows the steam turbine rotor to be cooled over its entire periphery, preferably in the vicinity of its outer side.

The parameters of the cooling medium are advantageously adapted in steps, by means of an open cooling system, as a function of the parameters of the working medium. For this purpose, the first region expediently has a first opening to the main flow. The second region advantageously also has a second opening to the main flow. This allows cooling of a plurality of blade stages, with the cooling medium in each case being at a pressure similar to that of the main flow, so that the differential pressure stresses are advantageously minimized.

The at least one passage could be integrated as a bore, groove or in some other suitable way. Furthermore it has proven very particularly favorable for the outer side of the rotor to be formed by an encircling shielding plate. This allows the steam turbine rotor to be completely shielded from the main flow in an advantageous way in the cooled blading region. This has significant advantages with regard to oxidation of the rotor material. An encircling shielding plate could expediently be held by a row of blades, in particular by the blade roots.

The at least one passage can be designed as required. For example, it has proven expedient for the passage to run through a blade, in particular through a blade root. In this case, a groove at a blade root could form part of the passage. If appropriate, it would also be possible for a bore running through a single blade root, or, as an alternative or in addition, through two adjacent blade roots to form part of the passage. Furthermore, it has proved expedient to provide a channel, which is connected to the passage, in a main blade part. This allows advantageous cooling of the main rotor blade part region, for example, by means of film cooling.

The invention also relates to a steam turbine having a steam turbine rotor in accordance with the concept proposed above or a refinement thereof.

With regard to the method, the object is achieved by the invention by means of a method for the active cooling of a steam turbine rotor of the type described in the introduction in which, according to the invention, there is provision for a fluid cooling medium to be guided continuously along the axial extent at least between a first region arranged in front of the first location and a second region arranged behind the first location.

According to a refinement of the invention, it is provided that the steam turbine rotor has a second location along the outer side, at which a second row of blades is held, the second location being arranged behind the first location along the axial extent, and the fluid cooling medium being guided continuously at least between a first region arranged in front of the first location and a second region arranged behind the second location. In this context, it has proven particularly advantageous for the cooling medium to be guided in a combined passage system along the axial extent over the first location and the second location and over a number of intervening further locations, at each of which a row of blades is held.

Since the working medium which flows into a steam turbine at its highest temperature is simultaneously also at its highest pressure, it is particularly expedient for the cooling medium to be fed to the steam turbine rotor from the outside. In this case, the pressure of the cooling medium advantageously exceeds a pressure of the working medium in the main flow.

It has proven particularly expedient for the cooling medium to be guided at a pressure which is modified as a function of a pressure of the main flow, and in particular for the cooling medium flow to be throttled. This refinement makes it possible to design an open cooling system which is adapted for higher steam parameters. Throttling of the cooling medium in order to match the pressure to the main flow, in an advantageous configuration, takes place in steps by using suitable configurations of the at least one passage, preferably in conjunction with openings to the main flow.

Furthermore, the cooling medium is expediently supplied at a temperature and/or in an amount which is/are modified as a function of a temperature of the main flow. This can advantageously be controlled by a fitting which satisfies safety requirements and in terms of control engineering tracks the quick-closing and actuating operations of the turbine valves. The temperature of the cooling medium is advantageously to be set according to safety requirements and to be monitored by control engineering. If appropriate, in the event of a weak load, a disproportionate amount of cooling medium can be introduced into the passage system, so that the temperature of the main flow is kept at a sufficiently low level downstream of the cooled blading region by increased introduction of cooling medium.

In the event of the supply of cooling medium failing, operation of the turbine can, if necessary, be interrupted with the aid of a number of turbine valves, a step known as quick closure.

The concept of supplying the cooling medium and guiding the cooling medium in a passage system which is integrated in the rotor, advantageously close to the surface, as explained above, can be designed and modified according to the particular requirements.

According to a variant of the invention, the proposed concept can also be used to start up and/or quickly cool down a turbine.

In a particularly advantageous configuration, the rotor and/or the turbine blades are provided with a thermally insulating coating. Thermally insulating layers of this nature usually have a relatively low heat conduction coefficient and can build up a high temperature difference provided that a suitable heat sink is locally provided. The function of this heat sink can be performed by the cooling system provided in the present instance, so that the rotor which is configured in this way is particularly suitable for the use of thermally insulating layers. In this case, rotor, blade roots and if appropriate, also main blade parts can be kept at a significantly lower temperature than if insulating layers of this type were not present. As an alternative to or in combination with the use of insulating layers it is also possible to use blade materials of comparatively poor thermal conductivity, such as, for example austenitic materials.

Exemplary embodiments of the invention will now be described below with reference to the drawing for comparison with the prior art, which is likewise illustrated. The drawing does not necessarily illustrate the exemplary embodiments to scale, but rather is presented in diagrammatic and/or slightly distorted form where it is expedient to do so for the purposes of explanation. To supplement the teaching which is directly apparent from the drawing, reference is made to the relevant prior art. In this context, it should be noted that numerous modifications and changes relating to shape and detail of an embodiment can be performed without departure from the general idea of the invention.

The features of the invention which are disclosed in the above description, in the drawing and in the claims can be pertinent to the configuration of the invention both individually and in any desired combination. The general idea of the invention is not restricted to the precise form or detail of the preferred embodiment which is shown and described below and is also not restricted to a subject matter which would be restricted by comparison with the subject matter claimed in the claims.

The preferred embodiment of the invention is described in connection with a cooling system which provides a pressure-matched mass flow of cooling steam which is able to cool the rotating components, i.e. the rotor and the rotor blades in a targeted manner. Consequently, the preferred embodiment proposed here can make a significant contribution to inexpensive, large-scale feasibility of higher steam parameters and higher efficiencies. Furthermore, an embodiment of the invention as described here, or a slightly different, modified embodiment, can also be implemented in order to allow the use of less expensive rotor and blade materials for current steam parameters.

DETAILED DESCRIPTION OF INVENTION

Figure 1:
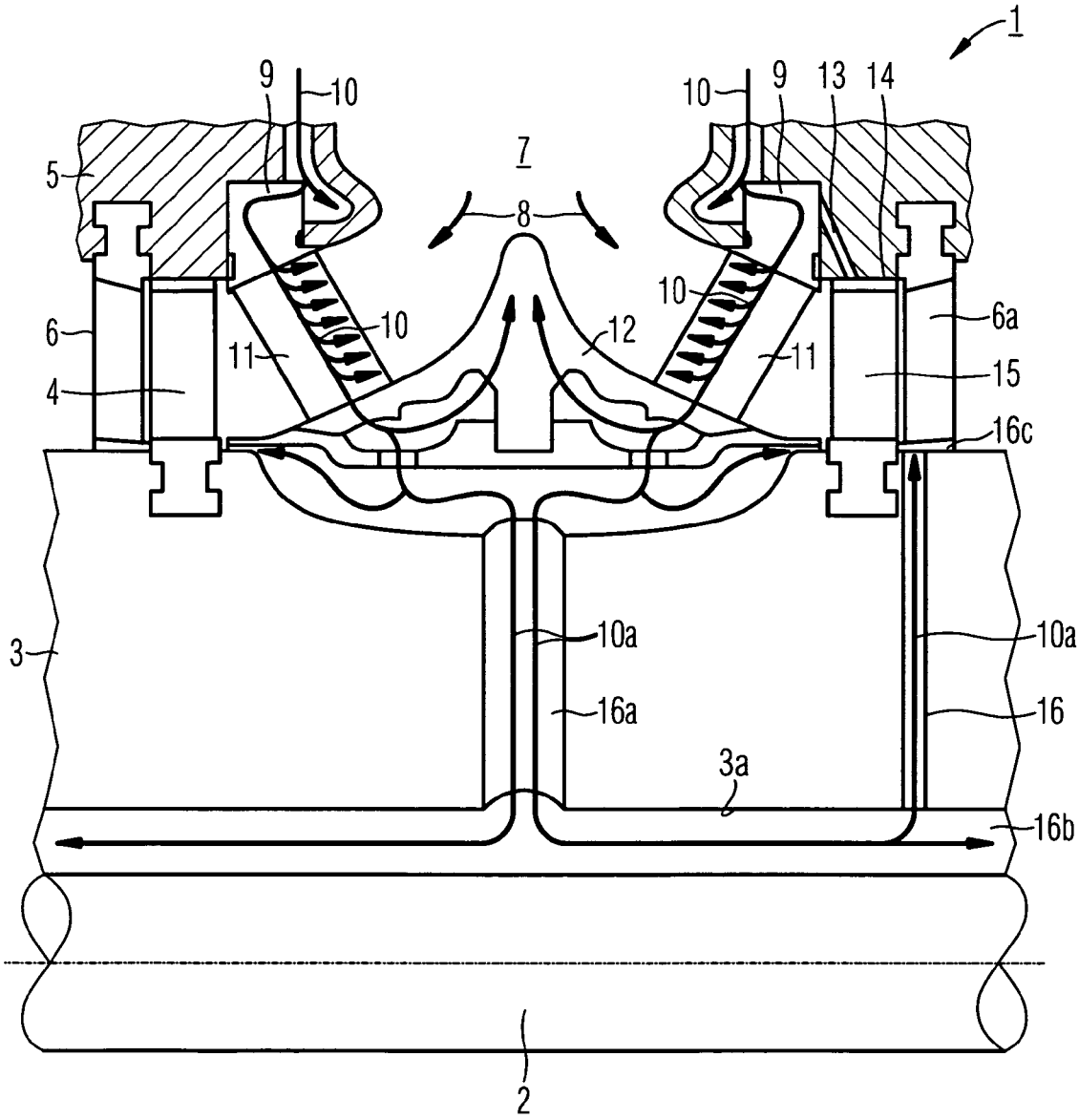
FIG. 1 shows a known cooling concept for a steam turbine rotor which is restricted to cooling in the inflow region of the working medium.

Known steam turbine rotors are fundamentally manufactured as solid, single-piece rotors, without any active cooling systems whatsoever. However, as illustrated in FIG. 1, the prior art in accordance with U.S. Pat. No. 6,102,654 has described a steam turbine 1 which has a cooling system which is restricted to cooling in the inflow region. This turbine has a rotor 3 arranged rotatably on an axle 2, with a number of rotor blades 4 arranged on its tubular shaft. These rotor blades are arranged in a stationary casing 5 with a set of guide vanes 6. The rotor 3 is driven by the working medium 8, which flows in in the inflow region 7, via the rotor blades 4. In addition to the working medium 8, a cooling medium 10 flows to the working medium 8 via a separate inlet region 9. The cooling medium 10 performs a cooling action only on a first ring 11 of the stationary guide vanes and a shielding plate 12 by flowing on to them. As a result, the thermal load on the rotor 3 and the first ring 11 of guide vanes is reduced. Moreover, cooling fluid 10 from an inlet region 9 of the cooling fluid 10 is passed beyond the first ring 11 of guide vanes, via a blocking line 13, to a region 14 which is located directly between the casing 5 and the first rotor blade 15. In this way, the inlet space 9 of the cooling fluid 10 is sealed off with respect to the working medium 8, with the cooling fluid 10 acting as a blocking fluid. The channel 13 itself is designed as a blocking line and does not act as a cooling line.

During the cooling of the rotor 3, cooling steam 10*a* is fed via a separate branch channel 16*a* to a substantially central cavity 16*b* which runs parallel to the rotor axle. From there, a cooling steam 10*a* of this nature is also fed back out via separate radial branch channels 16. The cooling steam 10*a* is in this way fed back to the main flow in regions 16*c* in order to cool the rotor at one location. The cooling medium 10*a* therefore substantially flows around the rotor 3 in an inflow region 7 and in a central cavity 16*b*. Effective cooling of the rotor itself is not provided, since the cooling medium is guided in the central cavity 16*b* at a distance from the rotor surface, and therefore not at a location where the heat is introduced. The separate channels 16*a*, 16 are designed as branch channels for cooling a specific location of the rotor and likewise cannot provide effective cooling of the rotor 3, since they run radially from a central cavity 16*b* to a region of the main flow 16*c*. The cooling of a rotor according to the prior art illustrated here is still in need of improvement, since it does not provide cooling close to the surface. Moreover, a relatively high rotor loading occurs as a result of the central cavity, and the machining outlay is also increased in view of the need to provide the branch channels. Furthermore, this concept does not sufficiently shield the rotor shaft from the main flow of the steam.

Figure 2:
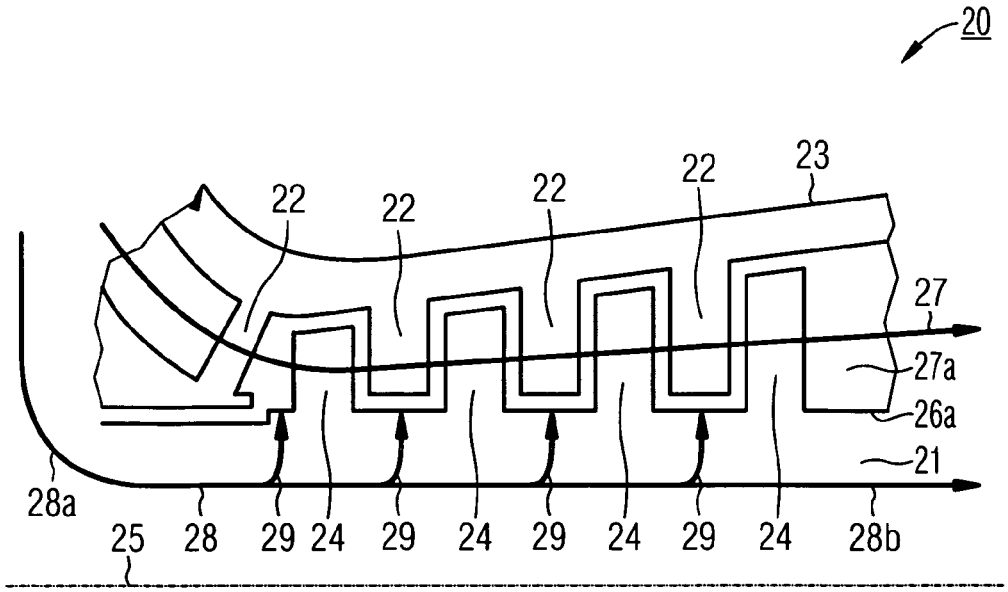
FIG. 2 diagrammatically depicts a cooling concept in a steam turbine rotor in accordance with a preferred embodiment.

FIG. 2 diagrammatically depicts a steam turbine 20 in accordance with a particularly preferred embodiment. It has a rotor 21 with a number of rotor blades 24, which is mounted rotatably in a casing 23 with a number of guide vanes 22. In this case, turbine 20 with rotor 21 and casing 23 extend along an axial extent 25. The rotatable rotor blades 24 engage like fingers into spaces between the stationary guide vanes 22.

The rotor 21 illustrated here has an outer side 26*a*. The outer side 26*a* adjoins an outer space 27*a* which is intended to receive a main flow 27 of a fluid working medium. The rotor has a number of locations on the outer side 26*a* at which a row of rotor blades 24 is in each case provided. According to the particularly preferred embodiment, a channel system 28 for guiding a cooling medium extends continuously from a first region 28*a*, past the locations for the rotor blades 24, to a second region 28*b*.

Along the axial extent 25, the channel system has a number of openings 29 to the main flow 27. By interacting with the through-openings of the channel system, these openings 29 serve to reduce the pressure of the cooling medium in steps, in parallel with the main flow 27. From stage to stage of the rotor blades 24, the cooling medium can preferably be throttled through flow resistances. The passage of the cooling medium through a bore, for example, at each rotor blade stage 24, is suitable for this purpose. During the throttling, the pressure is reduced without any technical work being performed. The cooling medium, at a similar pressure and lower temperature, has a higher density than the flow medium in the main flow, resulting in improved heat transfer properties. The increase in volume of the cooling medium which is brought about by throttling and a temperature increase can advantageously be compensated for by some of the cooling medium gradually being released to the main flow via the openings 29. This also ensures that the cooling medium pressure is well matched to the pressure of the main flow. The embodiment described here therefore provides an open cooling system.

In principle, a variant in which the cooling system is designed as a closed cooling system (not shown here) could also be provided in the preferred embodiment of a steam turbine rotor. This does have certain drawbacks, but depending on particular requirements, these can be accepted if desired. In the case of a closed cooling system, the cooling medium is not released to the main flow 27 or is only released to the main flow 27 at the end of the cooled region. In this case, therefore, the openings 29 of the open system shown in FIG. 2 would be substantially dispensed with. Cooling medium would simply be passed from a first region 28*a* to a second region 28*b*, without any direct pressure matching to the main flow. The stepped reduction in pressure could also be performed by throttling. In any event, there is no release of cooling medium to the main flow at each blade stage 24. Therefore, in the case of a closed cooling system, by way of example the cooling medium can simply not be released to the main flow 27 at all, can be released to the main flow 27 only in the end region 28*b* or can be released to the main flow 27 only at a greatly reduced number of stages 24. Consequently, the pressure in the channel system is only indirectly matched to the main flow. A drawback of this is that the cross sections required for the cooling medium grow in size significantly over the course of the channel system as a result of the temperature rise and pressure drop in a closed cooling system. This leads to an undesirable reduction in the bearing cross sections of blade roots and/or the rotor, since designing the channel system 28 as a closed channel system would mean that its cross section would have to grow from a first region 28*a* toward a second region 28*b* in order to take account of an increase in the volumetric flow. Although this runs contrary to the strength requirements in the rotor and blade securing region, it could be compensated for. If it is not intended for it to be possible for the cooling medium to be released to the working medium after it has performed its cooling task, for example, on account of excessively different pressure and temperature parameters, the cooling medium would be guided out of the rotor 21 separately from the working medium in a region 28*b*. Depending on the expansion range covered, a high pressure difference between flowing medium in the main flow 27 and the cooling medium in the closed channel system is established in the case of a plurality of stages 24 being cooled with a closed system if the openings 29 shown in FIG. 2 are not present. Depending on the choice of coolant pressure, this would be characterized by, in relative terms a deterioration in the cooling action or, with a high coolant pressure, by in relative terms a higher differential pressure load on the components. This is because the cooling medium has a low heat capacity at a low density and therefore the heat transfer which it brings about is reduced. Nevertheless, even a closed system is an active cooling system which is able to cool the steam turbine rotor 21 significantly more successfully compared to passive cooling or compared to just limited cooling in the inflow region of a rotor.

The open channel system 28 firstly has a continuous passage close to the surface, from which a plurality of branches bend off toward the openings 29. Furthermore, the embodiment shown here is a combined channel system 28, in the sense that separate further channels which could run out of the rotor surface are, as far as possible, avoided. This has the advantage that the cooling steam mass flow can decrease from stage to stage and that the same cooling steam can act over a plurality of stages. By comparison with individual channels 16 which are known from the prior art shown in FIG. 1 in a rotor or a casing, these channels being guided separately, the pressure required is based on the highest pressure of the main flow. With the separate channels according to the prior art, a pressure for the subsequent stages would no longer be matched. This leads to an additional load on the turbine resulting from a higher differential pressure. A higher pressure in separate channels would also, for a plurality of rows of blades, lead to a considerable increase in the mechanical load on the steam turbine rotor. Also, additional outlay for the provision of different pressure stages would have to be provided for separate channels, which is disadvantageous. In principle, however, as explained in the general part of the description, a passage system could, as a modification, be of flexible design and could also be composed of sub-systems.

Figure 3:
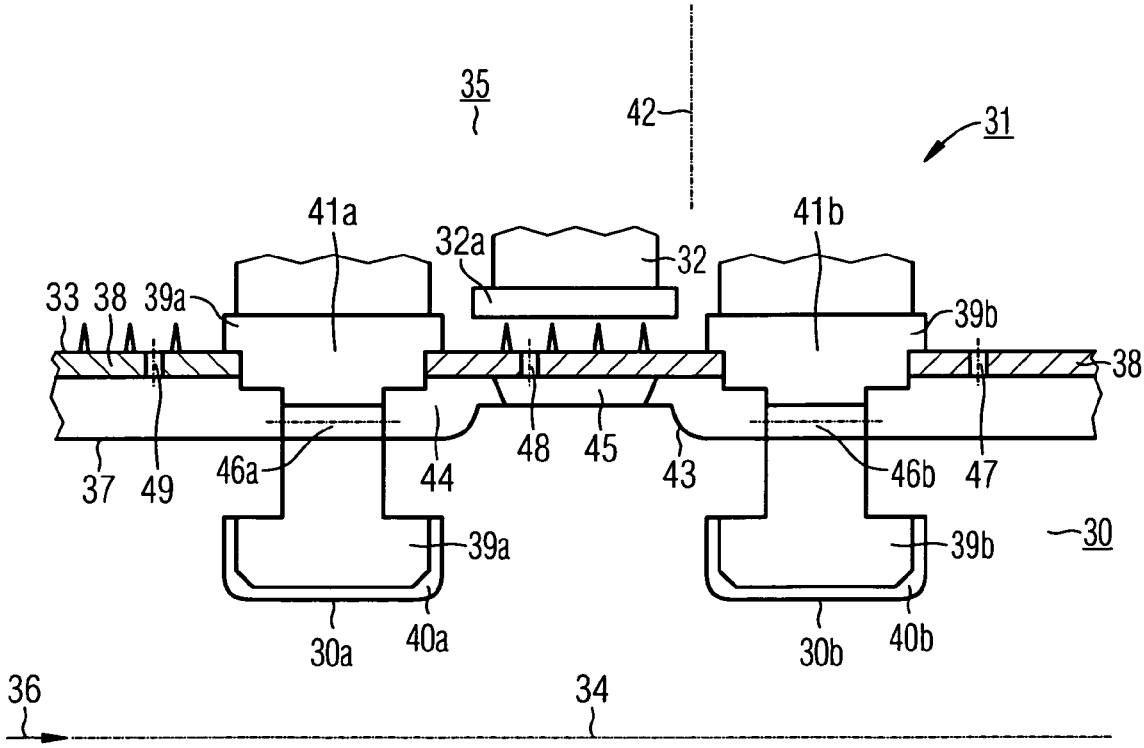
FIG. 3 depicts the feed of the cooling medium and the guiding of the cooling medium in a channel system, which is integrated in the rotor close to the surface, in the blading region for the preferred embodiment.

FIG. 3 provides a more detailed illustration of a steam turbine rotor 30 in accordance with the preferred embodiment, in the region of the cooled blading. Furthermore, a corresponding steam turbine 31 has a casing (not shown) with a set of guide vanes 32. The steam turbine rotor 30 in this case provides a first location 30*a* and a second location 30*b* along the outer side 33, with the second location 30*b* arranged behind the first location 30*a* along the axial extent 34. The outer side 33 adjoins an outer space 35, which is intended to receive a main flow 36 of a fluid working medium. In this case, however, the outer side 33 is not formed by the actual surface of the rotor shaft, but rather by a shielding plate 38 which rotates with the rotor and is held by the blade roots 39*a*, 39*b*. Furthermore, the blade roots 39*a*, 39*b* are anchored in blade grooves 40*a*, 40*b*. A number of blades 41*a* are arranged next to one another, in each case in a radial orientation 42, along the circumference of the rotor 30, thereby forming a first row of rotor blades, also referred to as a rotor blade stage, at the location 30*a*. In a corresponding way, a number of second blades 41*b* are arranged next to one another circumferentially in the groove 40*b* at a second location 30*b*, forming a second row of rotor blades.

An additional or alternative modification to the shielding plate 38 illustrated in FIG. 3 could also be provided by a shielding surface formed at the blade roots 39*a*, 39*b*. Although this would require additional outlay on materials and production, it would be possible to achieve a similar shielding action to that provided by a shielding plate 38, which could be advantageous depending on the particular requirements.

The channel system 43 shown in FIG. 3 has at least one passage 44 which extends continuously between a first region arranged in front of the first location 30*a* and a second region, which is arranged behind the first location 30*a* and in this embodiment also behind the second location 30*b*. In this embodiment, the passage 44 extends along virtually the entire blading region of the rotor (length as required). The passage 44 is formed firstly by the wall 37 of the rotor 30 and secondly by the shielding plate 38. A multiplicity of these passages 44 are arranged in the axial direction 34 along the outer side 33 at the circumference of the rotor 30. Moreover, the channel system 43 includes a number of circumferentially running grooves 45, which, in the present embodiment, are arranged along the axial extent 34, in each case at the level of a guide vane 32. The guide vane 32 has a cover plate 32*a*. The passages of the channel system 43 can be applied by milling into the surface 37 of the rotor shaft and can be covered by areal components of the shielding plate 38. In this case, the channel system 43 also incorporates blade grooves (FIG. 9, FIG. 10) and/or bores 46*a*, 46*b* (FIG. 5, FIG. 6, FIG. 9, FIG. 10) in blade roots 39*a*, 39*b* in the flow profile.

Moreover, the passage system 43 has openings 47, 48 and 49 for matching the pressure of the coolant flow to the pressure of the working medium flow by releasing some of the coolant flow to the main flow.

The shielding provided by a shielding plate 38 in the blading region can be achieved by also shielding the inflow region of the cooling medium by means of a further shielding plate, which is not shown here, providing further benefits with regard to oxidation of the turbine rotor material.

As an alternative or in addition to a shielding plate 38, it is also possible for a passage system 43 or a passage 44, 45 to be arranged in the form of bores or in some other suitable way inside the rotor 30, close to the surface.

Figure 4:
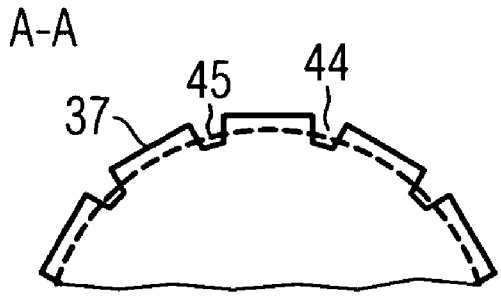
FIG. 4 shows a detailed view on section line A—A of the channel system shown in FIG. 3.

FIG. 4 shows the view on section line A—A from FIG. 3. In this figure, the encircling groove 45 shown in FIG. 3 is indicated by a dashed line. Accordingly, the axial groove 44 is diagrammatically indicated as an indentation in the surface 37 of the rotor shaft of the steam turbine rotor.

Figure 5:
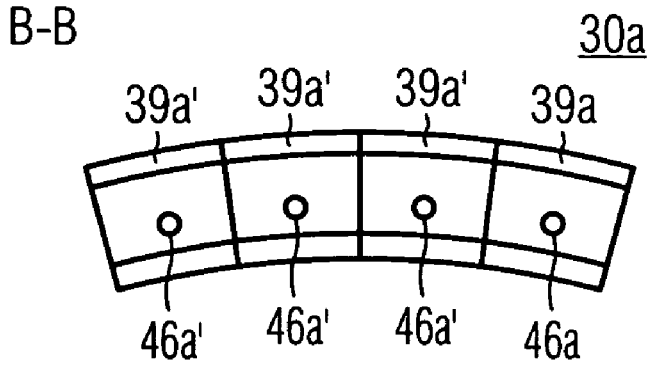
FIG. 5 shows a detailed illustration on section line B—B of the channel system shown in FIG. 3.

FIG. 5 shows a possible way of arranging a bore 46*a* in a blade root 39*a*. A multiplicity of blade roots 39*a*, 39*a*' arranged circumferentially next to one another along the rotor, with bores 46*a*, 46*a*', forms a row of blades at the location 30*a*.

Figure 6:
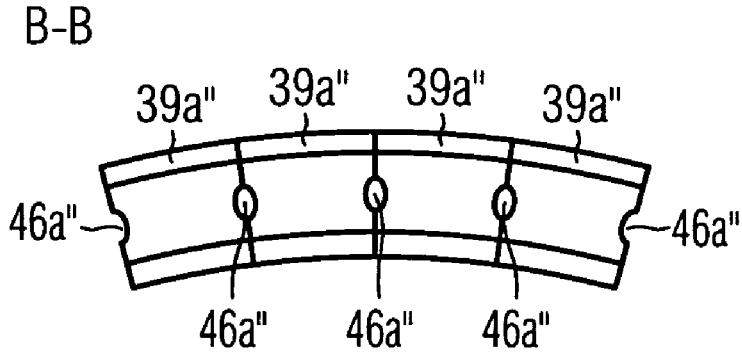
FIG. 6 shows a detailed illustration on section line B—B for a modified configuration of the channel system shown in FIG. 3.

An alternative configuration of the bores 46*a*, 46*a*' in FIG. 3 is illustrated in FIG. 6 as bore 46*a*". A bore 46*a*" is arranged in two respectively adjacent blade roots 39*a*".

Unlike in gas turbines, in steam turbines the working medium which flows to a part-turbine is at its highest pressure at the same time as it is at its highest temperature. To realize in particular an open cooling system for a steam turbine, therefore, suitable measures have to be taken to supply the cooling medium. The cooling medium can be supplied after such a medium has been removed from the water-steam circuit at a location of higher pressure and sufficiently low temperature. Suitable removal locations include in particular:

- prior to entry into the superheater parts of the boiler connected upstream of the part-turbine,
- before entering the boiler at all,
- after exiting an upstream part-turbine,
- from a tapping point from an upstream part-turbine,
- by separate provision by means of a suitable pump which removes the cooling medium from the preheating location at a low-pressure location and then pressurizes it to the required pressure. To prevent cooling failure in the event of the pump failing, additional outlay, if appropriate a redundant design, is required.

Figure 7:
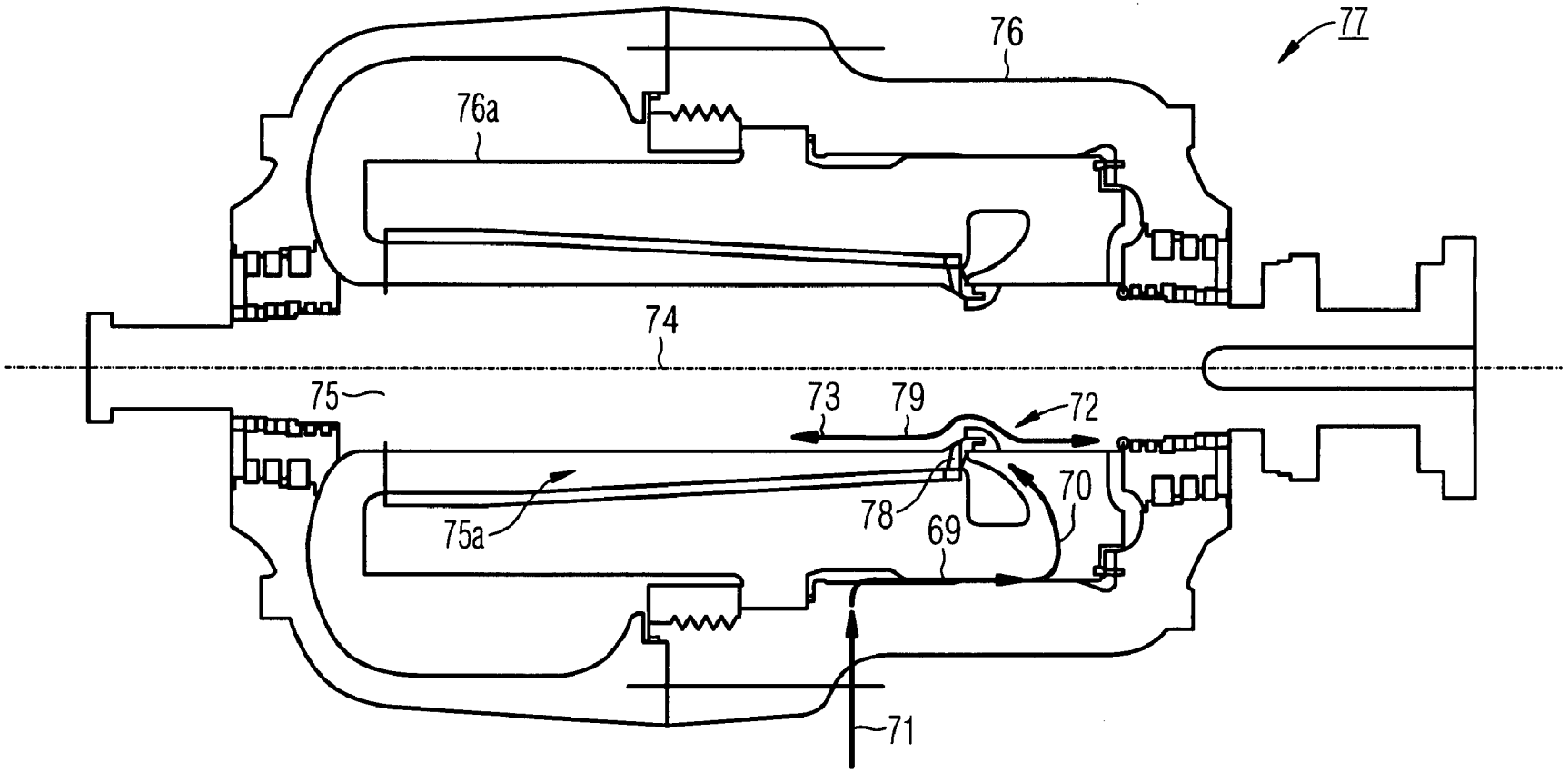
FIG. 7 diagrammatically depicts a possible way of transferring the cooling medium into the region where the rotor blades are secured in accordance with the preferred embodiment.

FIG. 7 shows a possibility 70 for transferring a cooling medium 71 from a region 72 in front of a first row 78 of guide vanes to a further region 73 where the rotor blades are secured along the axial extent 74 behind the first row 78 of guide vanes. This figure illustrates an inner casing 76*a*, which is arranged in an outer casing 76 of a steam turbine 77. The cooling medium can be introduced via a feed 70 into a channel system 79, which is close to the surface, in the rotor 75 and can be guided along the axial extent 74 in the region of the rotor blading 75*a*. The cooling medium can flow through the sealing region in parallel (cooling, reduction of enthalpy losses).

The flow 69 of cooling medium 71 in the outer casing 76 serves to cool the outer casing. The incoming flow of cooling medium is controlled by valves which satisfy safety requirements.

Figure 8:
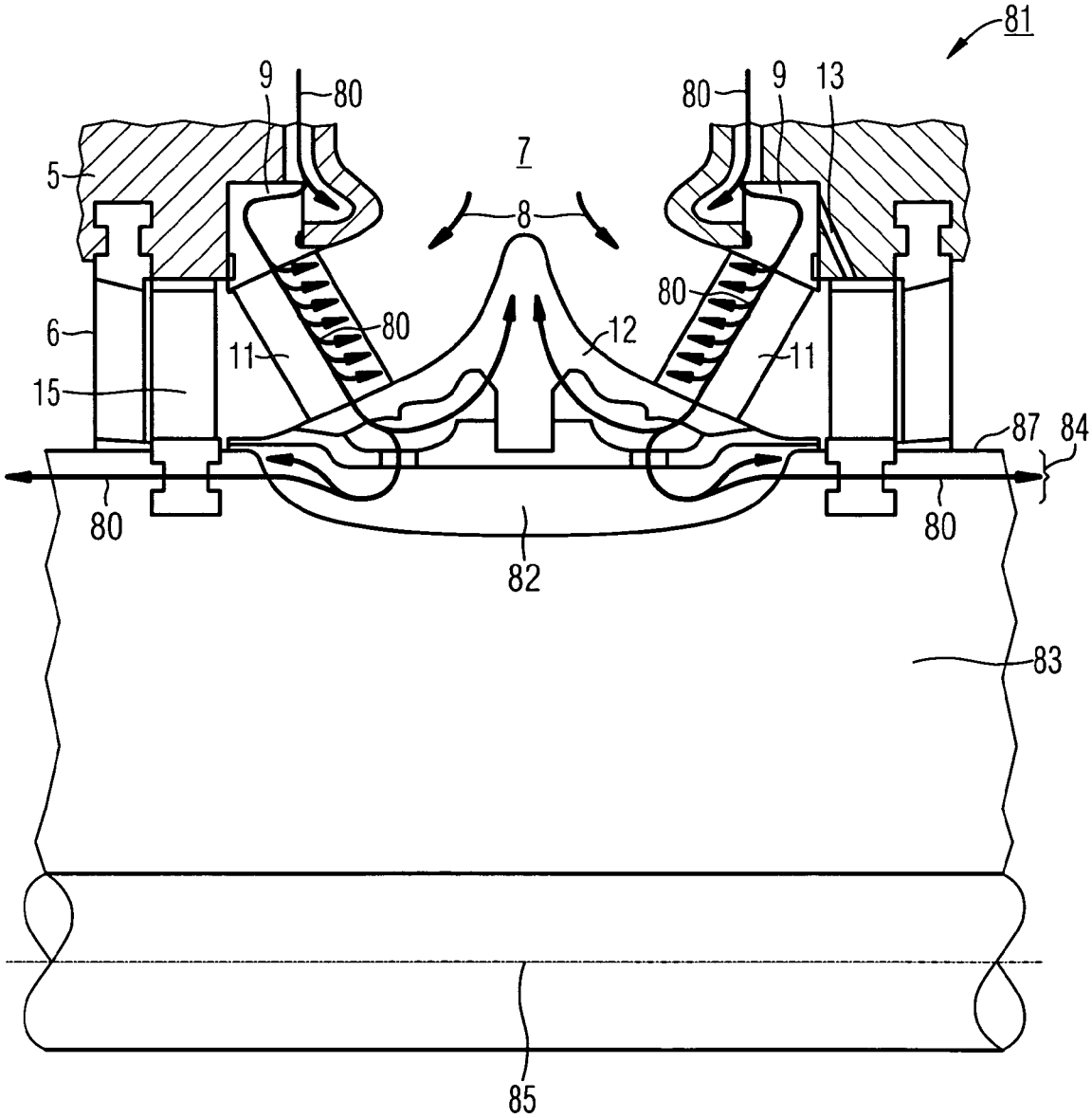
FIG. 8 depicts a further possible way of transferring the cooling medium into the region where the rotor blades are secured in accordance with the preferred embodiment.

In addition to the possibility 70 of introducing the cooling medium shown in FIG. 7 it would also be possible for cooling medium to be introduced into the channel system 79 which is integrated in the rotor in the region where the working medium flows in. FIG. 8 shows a further advantageous way of introducing cooling medium 80 in a preferred embodiment which now provides cooling close to the surface in a turbine 1 in accordance with the prior art as shown in FIG. 1. Those parts of the turbine 1 according to the prior art and of the turbine 81 in accordance with the particularly preferred embodiment which correspond to one another are provided with identical reference numerals. The following text describes the active cooling system for guiding the cooling medium 80 for active cooling of the rotor 83. The cooling medium 80 is fed to an inflow region of the working medium 8 via an inlet region 9, on the one hand, as has already been shown in FIG. 1. Furthermore, however, it is also passed through a shielding plate 12, and in a space 82 behind the shielding plate 12 the cooling medium 80 is guided along the axial extent 85 inside the rotor wall, close to the surface, i.e. in the region 84 where the rotor blades 15 are secured. In particular, the cooling medium 80 is guided continuously along the axial extent 85 at least between a first region 82 arranged in front of the first ring 15 of rotor blades and a second region 88 arranged behind the first ring 15 of rotor blades. In this embodiment of the turbine 81, the first region 82 is used in order to feed the cooling medium 80 to the axial passage system, which is close to the surface, of the rotor 83. Although not shown here, the cooling medium 80 may also be guided along practically the entire rotor blading region of the rotor 83 (actual configuration (length) dependent on technical requirements). In particular, all the other measures which are described with reference to the other figures in connection with the design of the active cooling system can be provided for the turbine 81, whether individually or in combination. In particular, in this embodiment shown in FIG. 8, the cooling system is likewise designed as an open cooling system.

When the cooling medium emerges at the end of the channel system and passes into the main flow, the cooling medium is substantially matched to the main flow, not only in terms of pressure but also in terms of the temperature of the main flow. This is a consequence of the uptake of heat by the cooling medium in the cooled blading region. The cooling medium then takes part in the further expansion in the main flow. This is a particular advantage of an open cooling system, which therefore transports enthalpy from the cooled blading region into the uncooled region.

The safety monitoring of the cooling medium in the embodiment shown here has in particular to control the temperature of the cooling medium. In this context, it should be ensured that premature condensation/droplet formation in the flow and in the channel system is avoided, even at partial loads. Furthermore, overheating of the main components, such as rotor, blades and blade-securing regions should be eliminated for all relevant load situations. Depending on the technical requirements, trimming between turbine valves and cooling medium valves may be provided for.

The described channel system of the preferred embodiment can also advantageously be used for preheating purposes by virtue of suitable medium being fed in during the starting-up operation. This medium can also be taken from other locations in the water-steam circuit than what subsequently forms the actual cooling medium. The fact that the preheating medium is throttled in the channel system and at least here does not contribute to running up a shaft section, has an advantageous effect in this context. This method can also be used analogously for rapid cooling. The procedures outlined above may offer advantages in terms of the start-up times and cooling times for future rotors or rotor materials.

Figure 9:
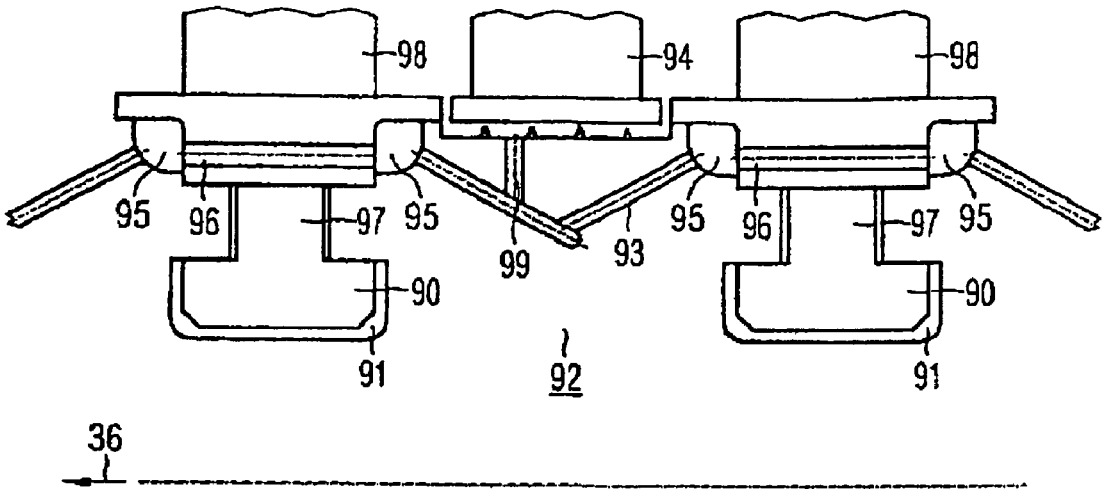
FIG. 9 illustrates a further possible configuration of the channel system for guiding the cooling medium in the region of the rotor blading.

FIG. 9 shows a further configuration of a channel system for guiding the cooling medium in the region of a blade root 90, which is anchored in a groove 91 in a turbine rotor 92. The axial passage 93 of the preferred embodiment is recessed deeper into the interior of a rotor 92 in the region of a guide vane 94 and therefore has, for example, a triangular profile in the region of the casing vane 94. Any other profile is possible. The passage 93 is open to the main flow via channels 99. A blade groove 95 is additionally incorporated into the region of the passage. Moreover, passage through a blade root 90 is effected by means of a channel 96 which is arranged above the constricted waist 97 of the blade root, closer to the main blade part 98. This has the advantage of having no adverse effect on the strength of the constricted waist 97 of the blade root.

Figure 10:
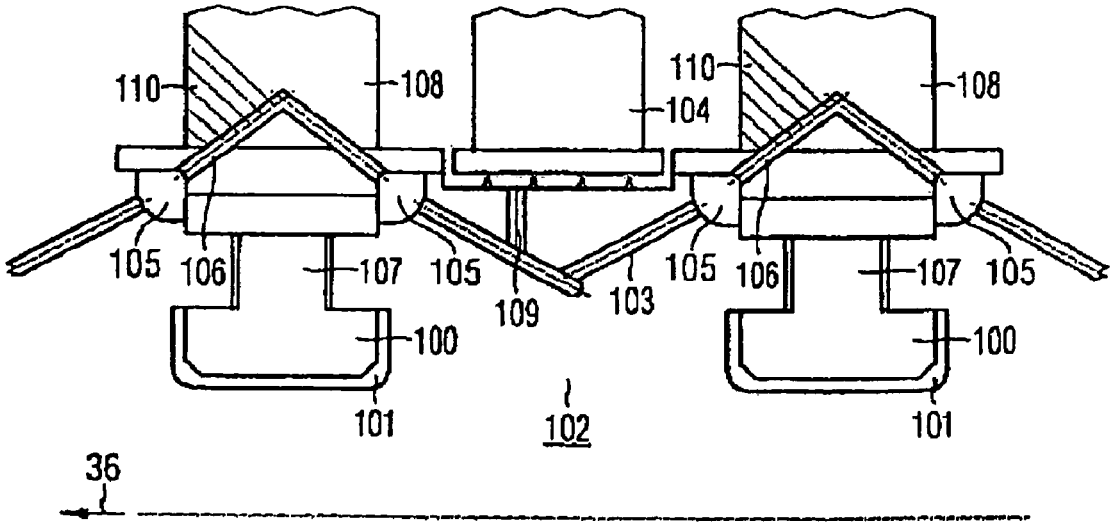
FIG. 10 illustrates yet a further possible configuration of the channel system for guiding the cooling medium in the region of the rotor blading.

FIG. 10 shows yet another configuration which is similar to that shown in FIG. 9. Unlike in FIG. 9, a passage 106 is also provided in the region of a main blade part 108. Channels 110 which pass cooling medium from a passage 106 onto the main blade part surface 108, in order to provide film cooling, lead off from the passage 106 in the region of the main blade part 108.

Furthermore, cooling medium is also released to the main flow of the working medium via a channel 109 in the region of a casing vane 104. Further details 100, 101, 102, 103, 107 correspond to those shown in FIG. 9.

Figure 11:
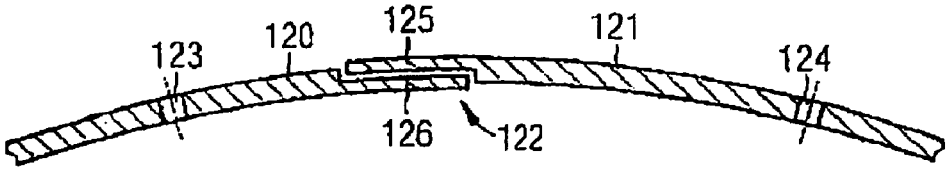
FIG. 11 illustrates a configuration of a shielding plate in an overlap region.

FIG. 11 shows a favorable arrangement of a first shielding plate 120 and a second shielding plate 121 in the region of an abutment joint 122. The detailed design illustrated here can advantageously be implemented for a shield 38 with passage openings 123 and 124 in FIG. 11 or 47, 48 and 49 in FIG. 3. A shielding plate of this type is advantageously made from a suitable material, for example a material which is able to withstand high temperatures. In this embodiment, it comprises partial pieces 120, 121, which at their abutment joints 122 preferably have a covering 125, 126 which is movable in order to cope with different temperatures.

In the configuration shown in FIG. 3, the shielding plate is located in the region of the guide vane cover plate and should have corresponding sealing tips, e.g. contactless seals. For this purpose, sealing tips could be formed over the periphery by turning, i.e. machined out of the solid material, or sealing strips could be jammed in. Which option proves advantageous can be determined in detail according to the strength and manufacturing requirements of the material and the specific design.

If the cooling medium is released to the main flow via the shaft seal of the guide vanes, the efficiency loss can under certain circumstances be reduced by the leakage mass flow which flows via these seals. In this case, the leakage mass flow consists not of hot medium from the main flow, but rather of cooling medium with a lower enthalpy. However, it is possible that this effect will be counteracted again by the reduced number of sealing tips resulting from the space which is needed to introduce the cooling medium.

To summarize, the invention proposes a steam turbine rotor, a steam turbine and a method for actively cooling a steam turbine rotor, as well as a suitable use of the cooling.

In steam turbines 1 which have been disclosed hitherto, a rotor is either only cooled passively or is only cooled actively to a limited extent in an inflow region of the working medium. As the loads on the rotor increase as a result of increased steam parameters of the working medium, sufficient cooling of the steam turbine rotor is no longer ensured. The proposed steam turbine rotor 21, 30 extends along an axial extent 25, 34 and includes: a channel system close to the surface along the axial extent 25, 34, an outer side 26*a* which adjoins an outer space 27*a*, 35 and is intended to receive a main flow 27, 36 of a fluid working medium 8, a first location 30*a* along the outer side 26*a*, 33, at which a first blade 41*a* is held, a second location 30*b* along the outer side 26*a*, 33 at which a second blade 41*b* is held, the second location 30*b* being arranged behind the first location 30*a* along the axial extent 25, 34. To ensure sufficient cooling, at least one passage 44, 46*a*, 46*b*, 93, 96, 103, 106 is provided, this passage, which is arranged close to the surface, extending continuously at least between a first region 28*a*, 72 arranged in front of the first location 30*a* and a second region 28*b*, 73 arranged behind the second location 30*b*. The invention also proposes a method and use in which a fluid cooling medium 10 is guided in a corresponding way.

Then invention claimed is:

1. A steam turbine rotor extending along an axial extent comprising:

an outer side adjoining an outer space arranged to receive a main flow of a fluid working medium, wherein the outer side is formed by a shielding plate which can rotate with the rotor;

a first location arranged along the outer side, at which a first blade is held; and at least one integrated passage extending continuously at least between a first region arranged in front of the first location and a second region arranged behind the first location, wherein a cooling medium is provided and guided at a pressure that is modified as a function of a pressure of the main flow.

2. The steam turbine rotor as claimed in claim 1, wherein a second location arranged along the outer side, at which a second blade is held, the second location arranged behind the first location along the axial extent and the passage extending continuously at least between a first region arranged in front of the first location and a second region arranged behind the second location.

3. The steam turbine rotor as claimed in claim 2, wherein a number of further locations, at each of which a blade is held, are arranged between the first location and the second location.

4. The steam turbine rotor as claimed in claim 1, wherein the at least one passage is part of a combined passage system which extends along the axial extent.

5. The steam turbine rotor as claimed in claim 1, wherein the at least one passage is part of a combined passage system which has an external feed which is provided for the incoming flow of cooling medium.

6. The steam turbine rotor as claimed in claim 1, wherein the at least one passage is part of a combined passage system which includes a channel which at least partially encircles a circumferential extent of the rotor.

7. The steam turbine rotor as claimed in claim 1, wherein the first region has a first opening to the main flow.

8. The steam turbine rotor as claimed in claim 1, wherein the second region has a second opening to the main flow.

9. The steam turbine rotor as claimed in claim 1 wherein a shield for the rotor shaft with respect to the main flow of the steam is at least partially formed by a blade root.

10. The steam turbine rotor as claimed in claim 1, wherein the shielding plate which can rotate with the rotor is held by a blade.

11. The steam turbine rotor as claimed in claim 1, wherein the passage leads through a blade, in particular through a blade root.

12. The steam turbine rotor as claimed in claim 1, further comprising a groove at a blade root, which groove is part of the passage.

13. The steam turbine rotor as claimed in claim 1, further comprising a bore through a single blade root and/or a bore through two adjacent blade roots, which bore is part of the passage.

14. The steam turbine rotor as claimed in claim 1, wherein a thermally insulating coating made from a material which has a lower heat conduction coefficient than a base material of the blade is provided on a blade surface.

15. A steam turbine rotor extending along an axial extent comprising:

an outer side adjoining an outer space arranged to receive a main flow of a fluid working medium;

a first location arranged along the outer side, at which a first blade is held;

at least one integrated passage extending continuously at least between a first region arranged in front of the first location and a second region arranged behind the first location, a channel in a main blade part, which channel is connected to the passage and permits axial flow directly from the first region to the second region; and wherein a cooling medium is provided and guided at a pressure that is modified as a function of a pressure of the main flow.

16. A method for actively cooling a steam turbine rotor extending along an axial extent and having an outer side, which adjoins an outer space which is intended to receive a main flow of a fluid working medium and having a first location along the outer side, at which a first blade is held, comprising:

providing a fluid cooling medium; and guiding the fluid cooling medium continuously within the steam turbine rotor along the axial extent, at least between a first region arranged in front of the first location and a second region arranged behind the first location, wherein the method is used for starting up and/or running down a steam turbine.

17. The method for actively cooling a steam turbine rotor as claimed in claim 16, wherein the steam turbine rotor has a second location along the outer side, at which a second blade is held, the second location arranged behind the first location along the axial extent, and the fluid cooling medium guided continuously at least between a first region arranged in front of the first location and a second region arranged behind the second location.

18. The method for actively cooling a steam turbine rotor as claimed in claim 17, further comprising:

guiding the cooling medium in a combined passage system along the axial extent over the first location and the second location and a number of intervening further locations, at each of which a blade is held.

19. The method for actively cooling a steam turbine rotor as claimed claim 16, further comprising:

feeding the cooling medium to the steam turbine rotor from the outside.

20. The method for actively cooling a steam turbine rotor as claimed in claim 16, further comprising:

guiding the cooling medium at a pressure which exceeds a pressure of the main flow.

21. The method for actively cooling a steam turbine rotor as claimed in claim 16, further comprising:

guiding the cooling medium at a pressure which is modified as a function of a pressure of the main flow.

22. The method for actively cooling a steam turbine rotor as claimed in claim 16, further comprising:

supplying the cooling medium at a temperature and/or in an amount which is/are modified as a function of a temperature of the main flow.

* * * * *